US006504519B1

(12) United States Patent
Ryu et al.

(10) Patent No.: US 6,504,519 B1
(45) Date of Patent: Jan. 7, 2003

(54) PLASMA DISPLAY PANEL AND APPARATUS AND METHOD OF DRIVING THE SAME

(75) Inventors: Ju Youn Ryu, Kyungsangbuk-do (KR); Eun Cheol Lee, Kyungsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/440,094

(22) Filed: Nov. 15, 1999

(30) Foreign Application Priority Data

Nov. 16, 1998 (KR) ..... 98-49102
Nov. 16, 1998 (KR) ..... 99-49281

(51) Int. Cl.[7] ..... G09G 3/28

(52) U.S. Cl. ..... 345/60; 345/54; 345/63; 345/66; 345/68

(58) Field of Search ..... 345/60, 62, 63, 345/54, 66, 68

(56) References Cited

U.S. PATENT DOCUMENTS 5,155,414 A * 10/1992 Sano ..... 316/169
5,587,624 A * 12/1996 Komaki ..... 313/584
5,962,983 A * 10/1999 Anderson et al. ..... 345/75
6,057,643 A * 5/2000 Kurai ..... 313/582
6,088,010 A * 7/2000 Makino et al. ..... 345/60
6,144,348 A * 11/2000 Kanazawa et al. ..... 345/60
6,184,849 B1 * 2/2001 Stoller ..... 345/72
6,242,864 B1 * 6/2001 Nakahara et al. ..... 315/169.3
6,252,574 B1 * 6/2001 Hosoi et al. ..... 345/103
6,255,777 B1 * 7/2001 Kim et al. ..... 313/582
6,256,076 B1 * 7/2001 Bae et al. ..... 349/38
6,262,699 B1 * 7/2001 Suzuki et al. ..... 345/68

FOREIGN PATENT DOCUMENTS

| | | |
|---|---|---|
| JP | 05135701 | 6/1993 |
| JP | 5135701 | 6/1993 |
| JP | 05266800 | 10/1993 |
| JP | 5-266800 | 10/1993 |
| JP | 06260092 | 9/1994 |
| JP | 08096714 | 4/1996 |
| JP | 083 6318 | 11/1996 |
| JP | 8-306318 | 11/1996 |
| JP | 09115450 | 5/1997 |
| JP | 9-115450 | 5/1997 |
| JP | 10333636 | 12/1998 |
| JP | 11126561 | 5/1999 |
| JP | 11144626 | 5/1999 |

* cited by examiner

*Primary Examiner*—Richard Hjerpe
*Assistant Examiner*—Abbas Abdulselam
(74) *Attorney, Agent, or Firm*—Birch, Stewart, Kolasch & Birch, LLP

(57) ABSTRACT

A plasma display panel and a driving apparatus, and method of operation thereof, that is capable of improving brightness. A plurality of sustaining electrode groups formed on a front substrate consist of at least three electrodes. The at least three electrodes are set to have a different distance from each other, thereby generating at least two discharges continuously. Each group of three electrodes has a center electrode and two side electrodes, the two side electrodes being spaced at different distances from the center electrode.

17 Claims, 12 Drawing Sheets

PLASMA DISPLAY PANEL AND APPARATUS AND METHOD OF DRIVING THE SAME

BACKGROUND OF THE INVENTION

1. Field of the Invention

This invention relates to a plasma display panel that is capable of improving the brightness as well as preventing a mis-discharge. Also, the present invention is directed to apparatus and method of driving the plasma display panel.

2. Description of the Related Art

Generally, a plasma display panel(PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current(AC) driving system.

The PDP with an AC driving system is expected to be preferred for future display devices because it has advantages in the use of a low voltage drive and a prolonged life in comparison to the PDP of a DC driving system. Also, the PDP of an alternating current driving system allows an alternating voltage signal to be applied between electrodes having dielectric layers therebetween to generate a discharge every half-period of the signal, thereby displaying a picture. Since such an AC driving system for a PDP uses a dielectric material, the surface of the dielectric material is charged with electricity. The AC-type PDP allows a memory effect to be produced by a wall charge accumulated on the dielectric material due to the discharge.

Referring to FIG. 1 and FIG. 2, the AC-type PDP includes a front substrate 1 provided with a plurality of sustaining electrodes 10, and a rear substrate 2 provided with a plurality of address electrodes 4. The front substrate 1 and the rear substrate 2 are spaced in parallel and have a plurality of barrier ribs 3 therebetween. A mixture gas such as Ne—Xe or He—Xe, etc. is injected into a discharge space defined by the front substrate 1 and the rear substrate 2 and the barrier ribs 3. Each sustaining electrode 10 consists of a transparent electrode 6 and a metal electrode 7. The transparent electrode 6 is usually made from Indium—Tin—Oxide and has an electrode width of about 300 $\mu$m. Usually, the metal electrode 7 has a three-layer structure of Cr—Cu—Cr and has an electrode width of about 50 to 100 $\mu$m. This metal electrode 7 plays a role to increase a resistance of the transparent electrode to a high resistance to thereby reduce a voltage drop. Such a sustaining electrode 10 makes a pair within a single plasma discharge channel. Any one of the pair of sustaining electrode 10 is used as a scanning/sustaining electrode that responds to a scanning pulse applied in an address interval to cause an opposite discharge along with an address electrode 4 while responding to a sustaining pulse applied in a sustaining interval to cause a surface discharge with the adjacent sustaining electrodes 10. Also, the sustaining electrode 10 adjacent to the sustaining electrode 10 used as the scanning/sustaining electrode is used as a common sustaining electrode to which a sustaining pulse is applied commonly. A distance a, between the sustaining electrodes 10 making a pair is set to be approximately 100 $\mu$m. On the front substrate 1 provided with the sustaining electrodes 10, a dielectric layer 8 and a protective layer 9 are disposed. The dielectric layer 8 is responsible for limiting a plasma discharge current as well as accumulating a wall charge during the discharge. The protective film 9 prevents damage of the dielectric layer 8 caused by a sputtering generated during the plasma discharge and improves an emission efficiency of secondary electrons. This protective film is usually made from MgO. Barrier ribs 3 for dividing the discharge space are extended perpendicularly at the rear substrate 2, and the address electrode 4 is formed between the barrier ribs 3. On the surfaces of the barrier ribs 3 and the address electrodes 4, a fluorescent layer 5 excited by a vacuum ultraviolet ray to generate a visible light is provided.

As shown in FIG. 3, the PDP 20 has mxn discharge pixel cells 11 arranged in a matrix pattern. At each of the discharge pixel cells 11, scanning/sustaining electrode lines Y1 to Ym, hereinafter referred to as "Y electrode lines", and common sustaining electrode lines Z1 to Zm, hereinafter referred to as "Z electrode lines", and address electrode lines X1 to Xn, hereinafter referred to as the "X electrode lines" are crossed with respect to each other. The Y electrode lines Y1 to Ym and the Z electrode lines Z1 to Zm consist of the sustaining electrode 10 making a pair. The X electrode lines X1 to Xn consist of the address electrodes 4.

FIG. 3 is a schematic view of a PDP driver shown in FIG. 1. In FIG. 3, the PDP driver includes a scanning/sustaining driver 22 for driving the Y electrode lines Y1 to Ym, a common sustaining driver 24 for driving the Z electrode lines Z1 to Zm, and first and second address drivers 26A and 26B for driving the X electrode lines X1 to Xn. The scanning/sustaining driver 22 is connected to the Y electrode lines Y1 to Ym to thereby select a scanning line and cause a sustaining discharge at the selected scanning line. The common sustaining driver 24 is commonly connected to the Z electrode lines Z1 to Zm to apply sustaining pulses with the same waveform to all the Z electrode lines Z1 to Zm, thereby causing the sustaining discharge. The first address driver 26A supplies odd-numbered X electrode lines X1, X3, . . . , Xn−3, Xn−1 with video data, whereas the second address driver 26B supplies even-numbered X electrode lines X2, X4, . . . , Xn−2, Xn with video data.

In such a PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The discharge pixel cells 11 to data are selected by the address discharge in the address interval. The selected discharge pixel cells 11 sustain the discharge in the sustaining interval. The sustaining interval is lengthened by an interval corresponding to $2^n$n depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

FIG. 4 shows signals applied so as to drive the AC-type PDP. In FIG. 4, the AC-type PDP is driven with a drive cycle being divided into a reset interval for initializing the entire field, an address interval for selecting the discharge pixel cells 11 displaying data, and a sustaining interval for sustaining a discharge of the selected discharge pixel cells 11. Reset pulses RPx and RPz are applied to the X electrode lines X1 to Xn and the Z electrode lines Z1 to Zm in the reset interval. A reset discharge is generated between all the X electrode lines X1 to Xn and all the Z electrode lines Z1 to Zm within the PDP 20 by the reset pulses RPx and RPx to thereby initialize the entire field. In the address interval, a writing pulse WP including data for one line is applied to the X electrode lines X1 to Xn and scanning pulses −SCP1, −SCP2, . . . , −SCPm synchronized with the writing pulse WP are sequentially applied to the Y electrode lines Y1 to Ym. Then, an address discharge is generated between the X electrode lines X1 to Xn and the Y electrode lines Y1 to Ym by voltage differences between the writing pulse WP and the scanning pulses −SCP1, −SCP2, . . . , −SCPm. By this address discharge, the discharge pixel cells 11 displaying data are selected. At this time, a wall charge and charged particles are formed at the discharge pixel cells 11 generating the address discharge, whereas a wall charge and charged particles are not formed at the discharge pixel cells 11 without data. In this address interval, a positive DC voltage lower than a voltage level of the writing pulse WP is applied to the Z electrode lines Z1 to Zm to prevent mis-discharge between the X electrode lines X1 to Xn and the Z electrode lines Z1 to Zm and between the Y electrode lines Y1 to Ym and the Z electrode lines Z1 to Zm. In the sustaining interval, a sustaining pulse SUSP having an inverted phase with respect to each other is applied to the Y electrode lines Y1 to Ym and the Z electrode lines Z1 to Zm. At this time, a sustaining discharge is generated within the discharge pixel cells 11 selected every sustaining pulse SUSP while a voltage caused by a wall charge and charged particles formed in advance within the discharge pixel cells 11 generating the address discharge is added to the sustaining pulse SUSP applied to the Y electrode lines Y1 to Ym and the Z electrode lines Z1 to Zm. On the other hand, the discharge pixel cells 11 in which the address discharge is not generated, do not generate a discharge because an electric field able to cause the discharge is not applied to the corresponding discharge pixel cells 11 even when the sustaining pulse SUSP is applied. If a plasma display occurs as described above, then a vacuum ultraviolet ray is generated. This vacuum ultraviolet ray excites the fluorescent layer 5 to display a picture.

As seen from FIG. 4 and FIG. 5, however, the conventional PDP has a problem in that, since the sustaining pulse SUSP applied to the adjacent sustaining electrode 10 is coupled between the adjacent discharge spaces 30, and have an inverted polarity with respect to each other, a mis-discharge may be generated between the adjacent discharge spaces 30. Also, it has a problem in that a time contributing to a luminescence in the entire sustaining interval is only about 1 $\mu$s per sustaining pulse SUSP. More specifically, the sustaining pulse SUSP has a frequency of tens of kHz to hundreds of kHz and a pulse width of several $\mu$s, but charged particles and wall charges generated while a discharge is caused by the sustaining pulse SUSP, reduce an electric field in the discharge space. As a result, because a discharge is not generated successively in a time interval when the sustaining pulse SUSP is applied, but a discharge is stopped just after the sustaining pulse SUSP was applied, the sustaining interval is not utilized effectively and the brightness is lowered.

SUMMARY OF THE INVENTION

Accordingly, it is an object of the present invention to provide a plasma display panel and driving apparatus and method thereof that are capable of improving the brightness.

Further object of the present invention is to provide a plasma display panel and driving apparatus and method thereof that are capable of preventing a mis-discharge.

In order to achieve these and other objects of the invention, according to one aspect of the present invention, each of a plurality of sustaining electrode groups in a PDP includes at least three electrodes a center electrode and two side electrodes, respectively spaced at different distances from the center electrode.

According to another aspect of the present invention, a PDP driving apparatus includes a sustaining electrode group including the at least three electrodes; and a sustaining electrode driver for applying the same polarity of voltage signals to side electrodes positioned at the outermost portions of each side of the center electrode.

According to still another aspect of the present invention, a PDP driving apparatus includes the steps of making a sustaining electrode group formed on a front substrate from at least three electrodes; and setting said at least three electrodes to have different spaces from each other to thereby generate at least two discharges continuously.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
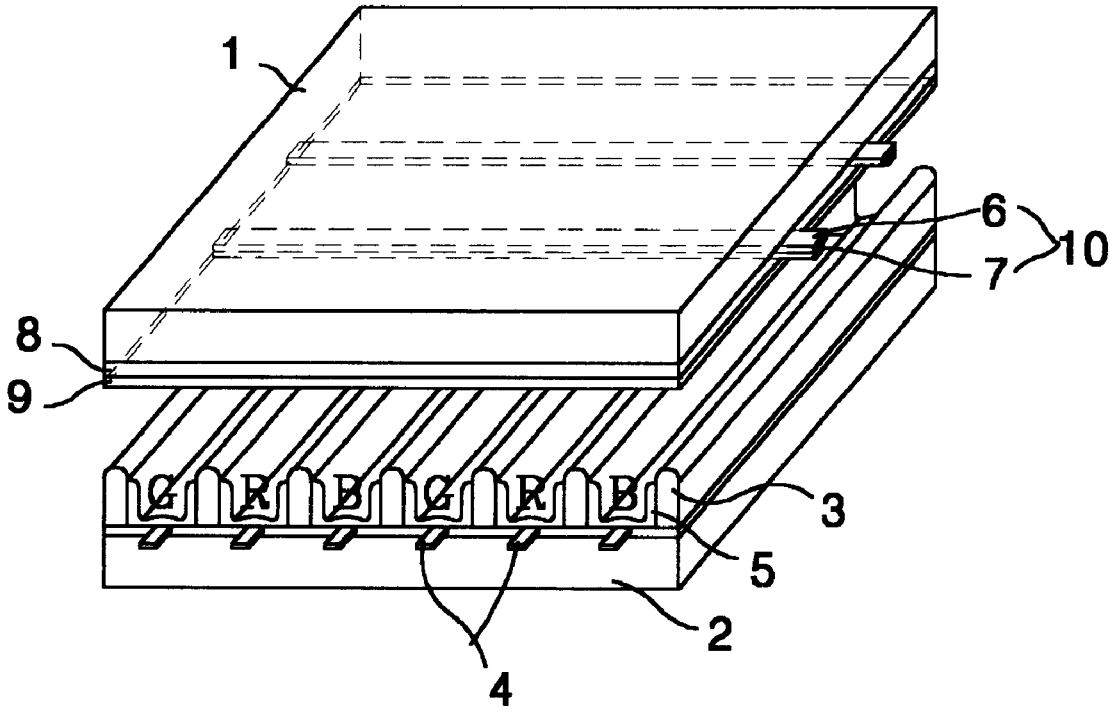
FIG. 1 PRIOR ART
FIG. 1 is a schematic perspective view showing the structure of a conventional three-electrode, AC-type plasma display panel.
Figure 2:
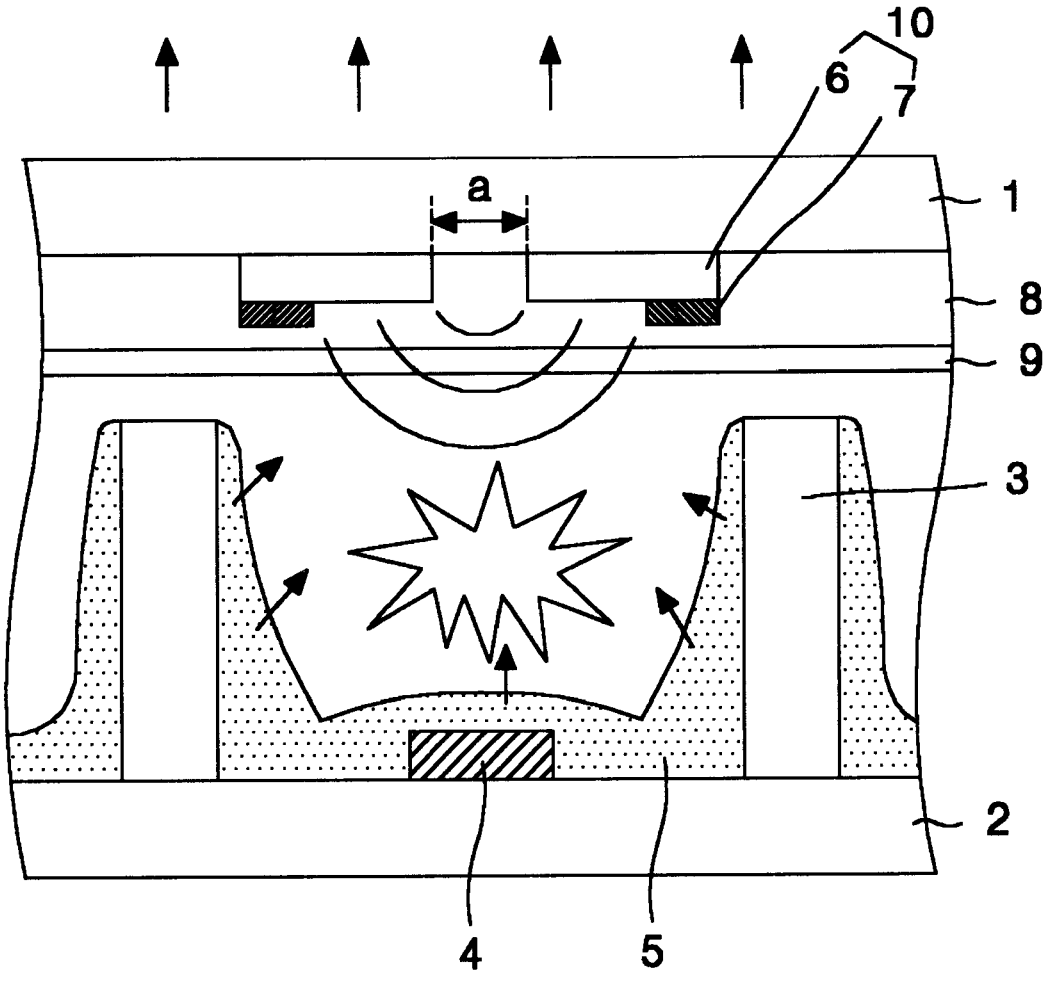
FIG.2 PRIOR ART
FIG. 2 is a sectional view showing the structure of a single discharge pixel cell in the plasma display panel of FIG. 1.
Figure 3:
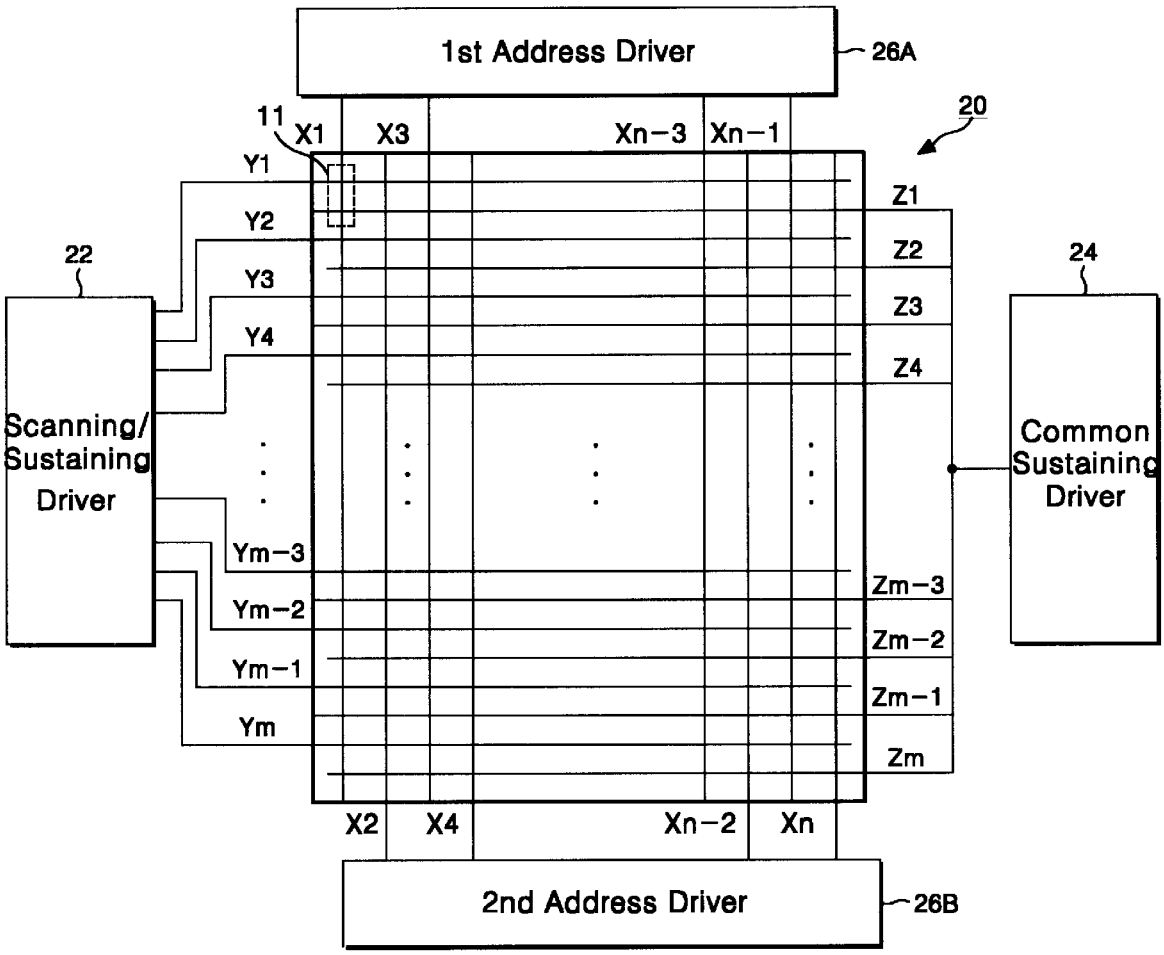
FIG.3 PRIOR ART
FIG. 3 is a schematic block diagram showing the plasma display panel in FIG. 1 and a driving apparatus thereof.
Figure 4:
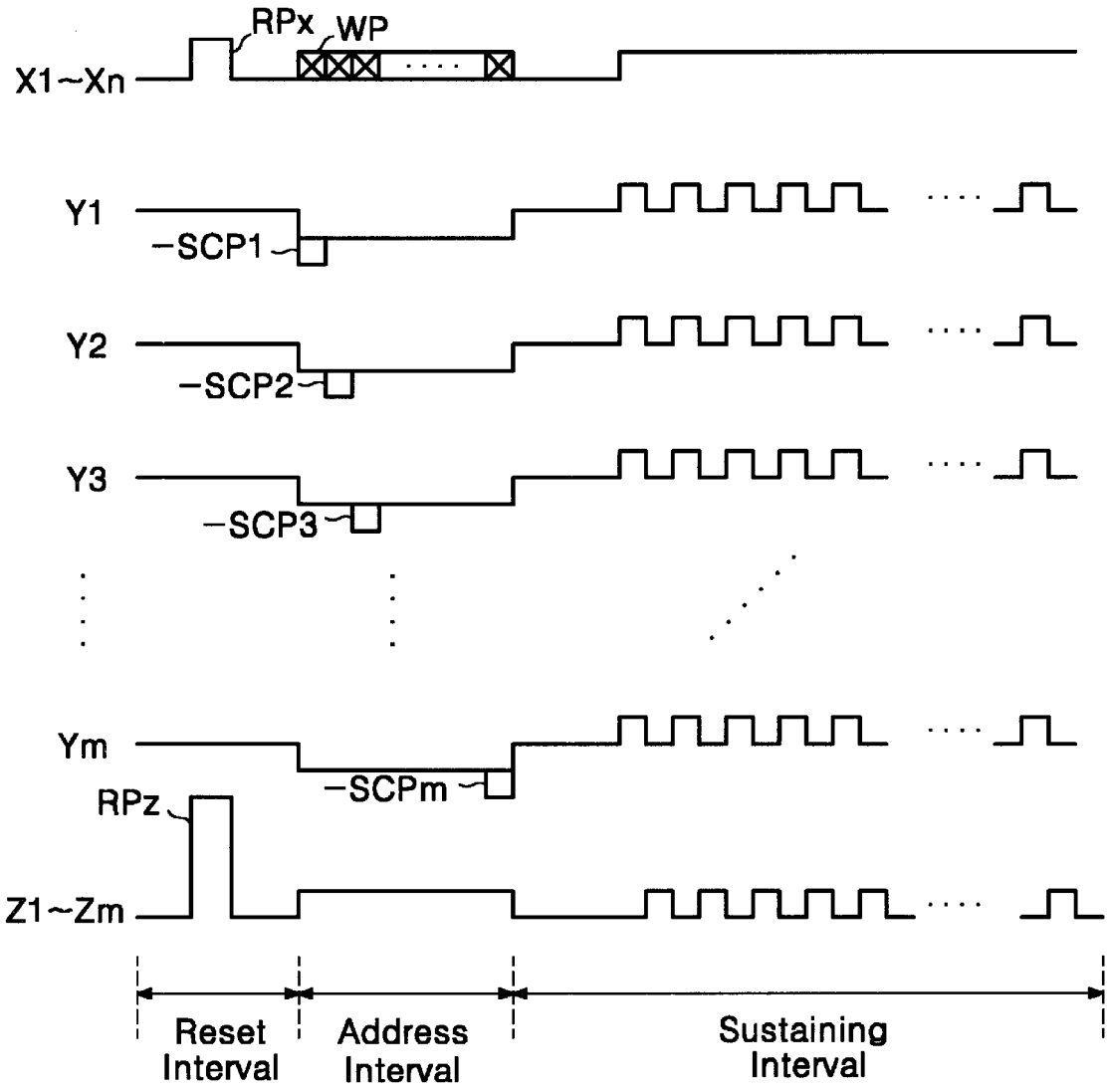
FIG.4 PRIOR ART
FIG. 4 is waveform diagram of driving signals for the plasma display panel shown in FIG. 1.
Figure 5:
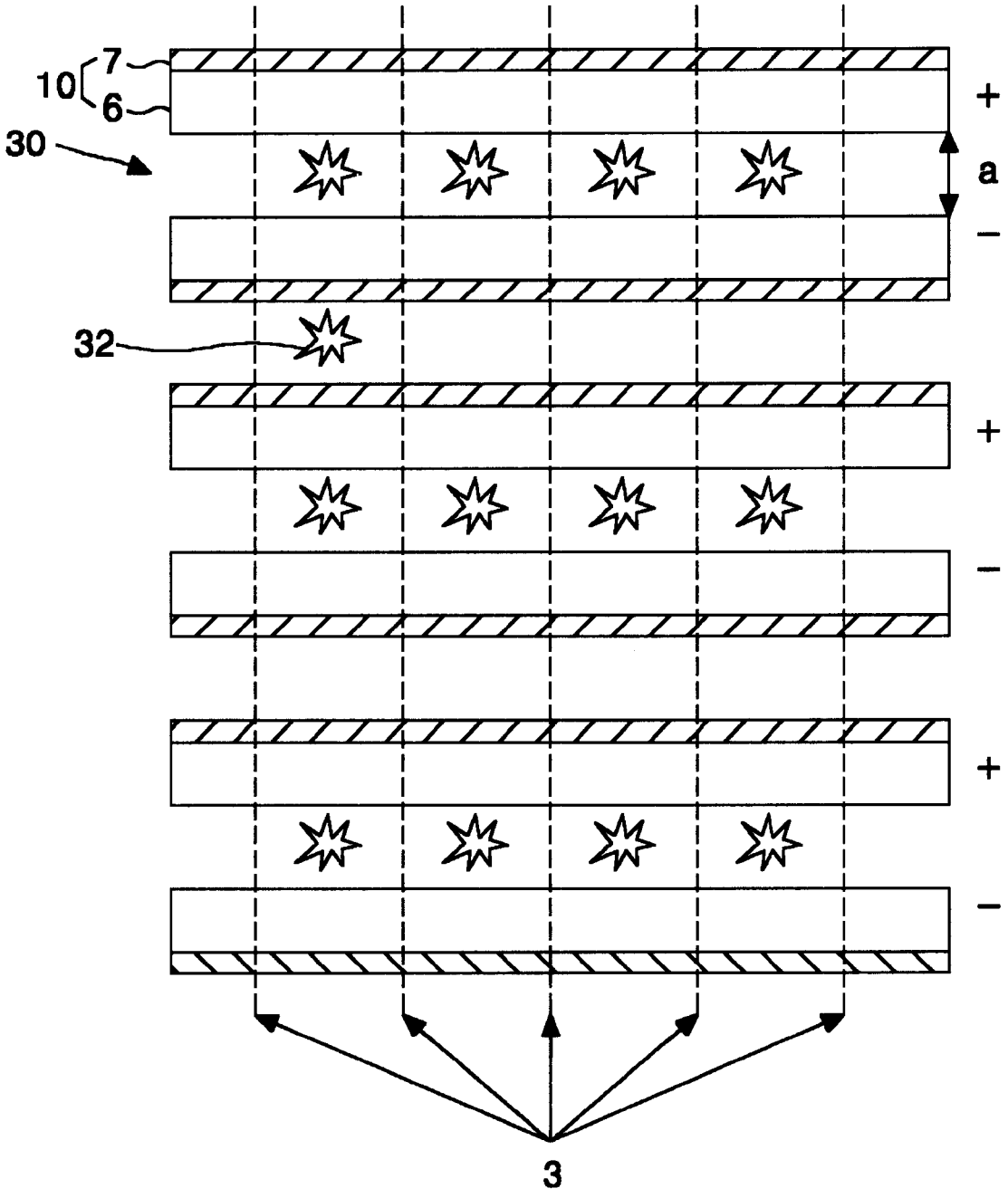
FIG.5 PRIOR ART
FIG. 5 is a plan view representing a mis-discharge in the plasma display panel of FIG. 1.
Figure 6:
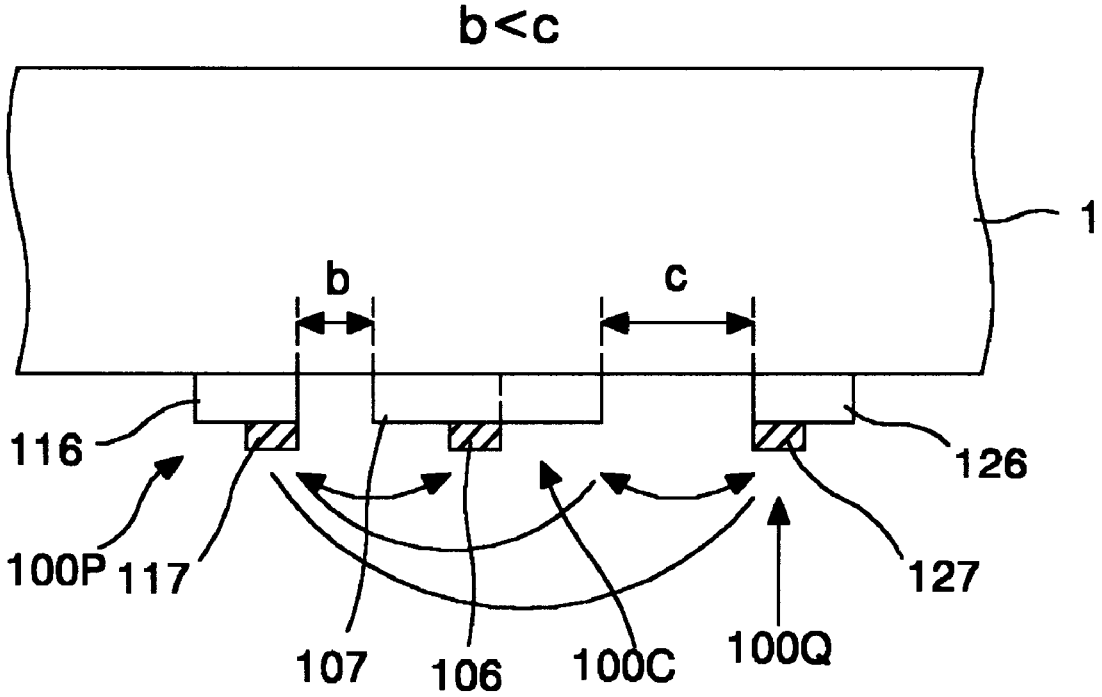
FIG. 6 is a sectional view showing the structure of a front substrate in the plasma display panel according to a first embodiment of the present invention.

Referring to FIG. 6, there is shown a plasma display panel(PDP) according to an embodiment of the present invention that includes sustaining electrode groups 100C, 100P and 100Q formed on a front substrate 1 having a different spaces with respect to each other. The sustaining electrode groups 100C, 100P and 100Q consists of a center electrode 100C and side electrodes 100P and 100Q arranged at each side of the center electrode 100C. A space c between the center electrode 100C and the right side electrode 100Q is set to be larger than a distance between the center electrode 100C and the left side electrode 100P. In the sustaining electrode group 100C, 100P and 100Q set to a different space as mentioned above, a first discharge is generated between the center electrode 100C and the left side electrode 100P having a short distance and then a second discharge is generated between the center electrode 100C and the left side electrode 100P having a relatively larger distance in a sustaining interval. The sustaining electrode group 100C, 100P and 100Q consist of transparent electrodes 106, 116 and 126 with a wide electrode width and metal electrodes 107, 117 and 127 with a narrow electrode width. The metal electrode 107 in the center electrode 100C is formed in such a manner to be offset from the center of the transparent electrode 106 toward the left side electrode 100p. The purpose of this is to generate the first discharge between the center electrode 100C and the left side electrode 100P with a low voltage. Also, the metal electrodes 107 and 127 in the left and right side electrodes 100P and 100Q are located in such a manner to be close to the center electrode 100C in order to lower a discharge initiation voltage required for the first and second discharge. Accordingly, the left and right side electrodes 100P and 100Q are provided at the ends of the transparent electrodes 116 and 126 adjacent to the center electrode 100C. In order to improve an emission efficiency, electrode widths of the transparent electrodes 106, 116 and 126 are set in such a manner that the width relationship among the left side electrode 100P, the center electrode 100C and the right side electrode 100Q has a ratio of 1:2:1.

Figure 7:
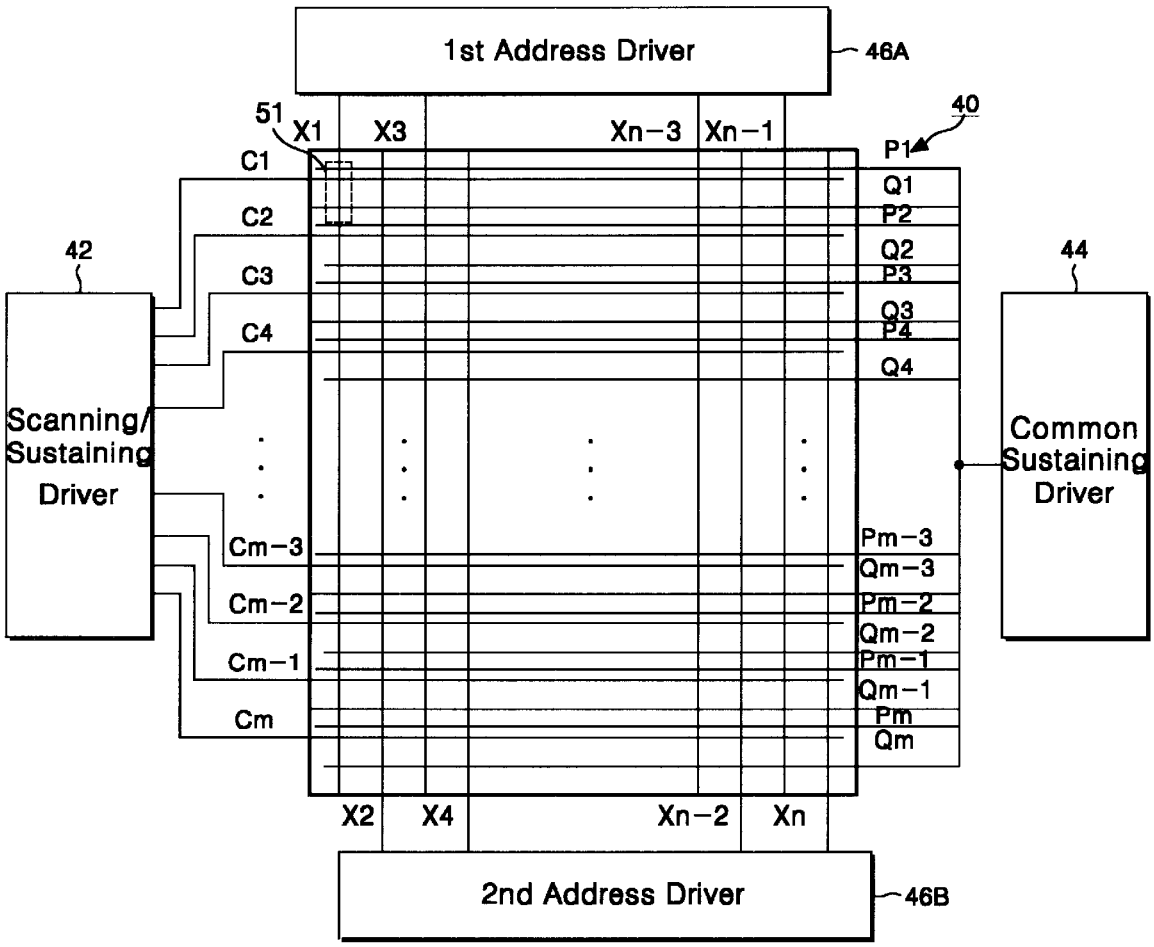
FIG. 7 is a schematic block diagram showing the plasma display panel in FIG. 6 and a driving apparatus thereof.

As seen from FIG. 7, such a PDP 40 has mxn discharge pixel cells 51 arranged in a matrix pattern. In each of the discharge pixel cells 51, center electrode lines C1 to Cm, hereinafter referred to as "C electrode lines", left side electrode lines P1 to Pm, hereinafter referred to as "P electrode lines", right side electrode lines Q1 to Qm, hereinafter referred to as "Q electrode lines" and X electrode lines X1 to Xn are crossed with respect to each other.

Referring now to FIG. 7, there is shown a PDP driving apparatus according to a first embodiment of the present invention. In FIG. 7, the PDP driving apparatus includes a scanning/sustaining driver 42 for driving the C electrode lines C1 to Cm, a common sustaining driver 44 for driving the P electrode lines P1 to Pm and the Q electrode lines Q1 to Qm, and first and second address driver 46A and 46B for driving the X electrode lines X1 to Xn. The scanning/sustaining driver 42 is connected to the C electrode lines C1 to Cm to thereby select a scanning line to be displayed and cause a sustaining discharge at the selected scanning line. The common sustaining driver 44 is commonly connected to the P electrode lines P1 to Pm and the Q electrode lines Q1 to Qm to apply sustaining pulses with same waveform to all the P electrode lines P1 to Pm and all the Q electrode lines Q1 to Qm, thereby causing the sustaining discharge. The first address driver 46A supplies odd-numbered X electrode lines X1, X3, . . . , Xn−3, Xn−1 with a video data, whereas the second address driver 46B supplies even-numbered X electrode lines X2, X4, Xn−2, Xn with a video data.

Figure 8:
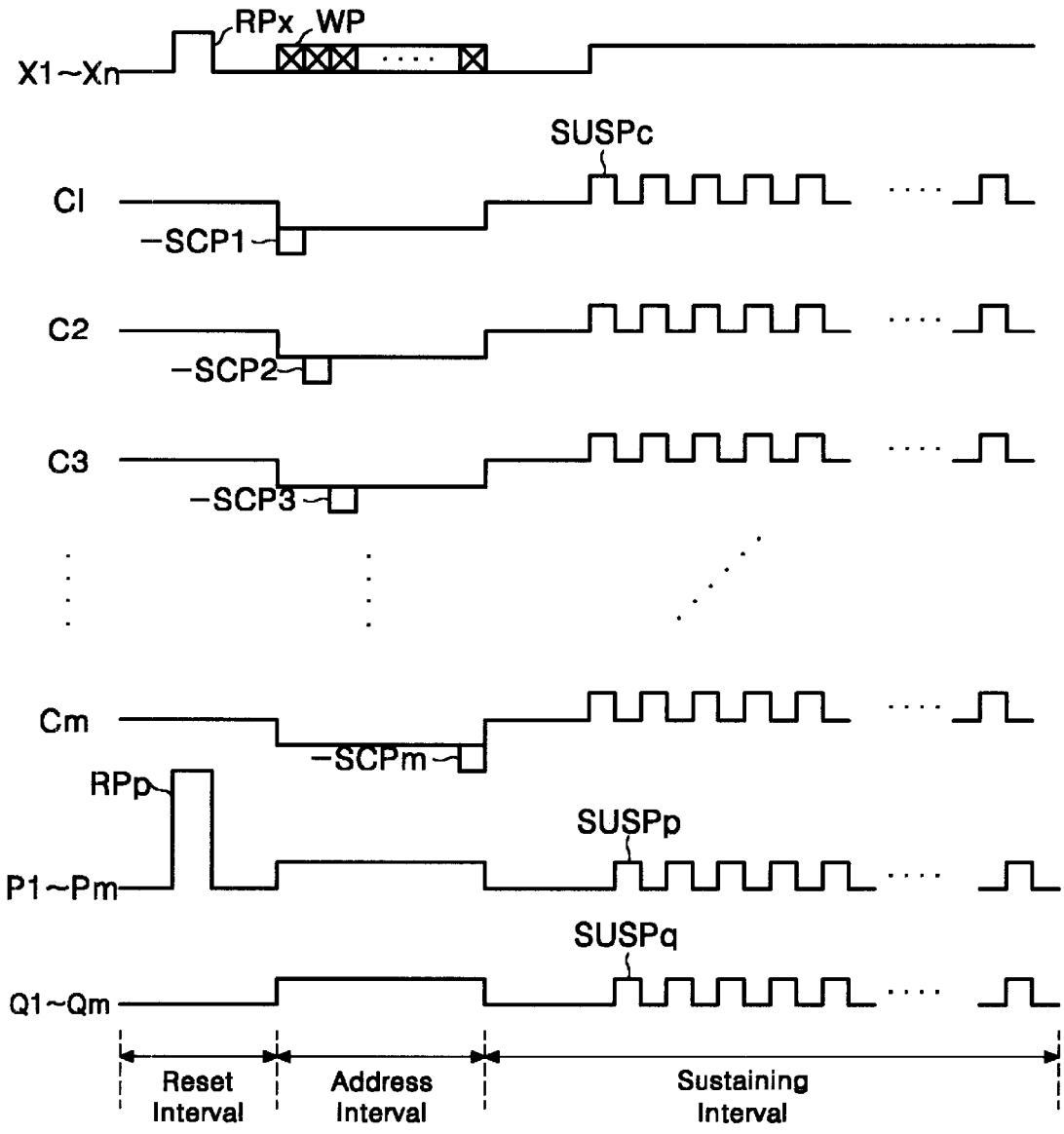
FIG. 8 shows driving waveforms for explaining a driving method of the plasma display panel according to a first embodiment of the present invention.

FIG. 8 shows drive signals applied to the PDP 40 by the driving apparatus in FIG. 7. Referring to FIG. 8, the PDP is driven with a drive cycle being divided into a reset interval for initializing the entire field, an address interval for selecting the discharge pixel cells 51 displaying a data and a sustaining interval for sustaining a discharge of the selected discharge pixel cells 51. Reset pulses RPx and RPp are applied to the X electrode lines X1 to Xn and the P electrode lines P1 to Pm in the reset interval. A reset discharge is generated between all the X electrode lines X1 to Xn and all the P electrode lines P1 to Pm within the PDP 40 by the reset pulses RPx and RPp to thereby initialize the entire field. In the address interval, a writing pulse WP including a data for one line is applied to the X electrode lines X1 to Xn and scanning pulses −SCP1, −SCP2, . . . , −SCPm synchronized with the writing pulse WP are sequentially applied to the C electrode lines C1 to Cm. Then, an address discharge is generated between the X electrode lines X1 to Xn and the C electrode lines C1 to Cm by voltage differences between the writing pulse WP and the scanning pulses −SCP1, −SCP2, −SCPm. By this address discharge, the discharge pixel cells 51 displaying a data are selected. At this time, wall charges and charged particles are formed at the discharge pixel cells 51 generating the address discharge, whereas wall charges and charged particles are not formed at the discharge pixel cells 51 without a data. In this address interval, a positive DC voltage lower than a voltage level of the writing pulse WP is applied to the P electrode lines P1 to Pm and the Q electrode lines Q1 to Qm. In the sustaining interval, a sustaining pulse SUSPc is applied to the C electrode lines C1 to Cm. Also, sustaining pulses SUSPp and SUSPq having an inverted phase with respect to the sustaining pulse SUSPc applied to the C electrode lines C1 to Cm are applied to the P electrode lines P1 to Pm and the Q electrode lines Q1 to Qm. At this time, two sustaining discharges are generated within the discharge pixel cells 51 selected every sustaining pulse SUSPc, SUSPp and SUSPq while a voltage caused by wall charges and charged particles formed in advance within the discharge pixel cells 51 generating the address discharge is added to the sustaining pulses SUSPc, SUSPp and SUSPq applied to the C electrode lines C1 to Cm, the P electrode lines P1 to Pm and the Q electrode lines Q1 to Qm, respectively. First, the instant that the sustaining pulses SUSPc, SUSPp and SUSPq are applied, the first discharge is generated between the C electrode lines C1 to Cm and the P electrode lines P1 to Pm having a narrow distance. By this first discharge, wall charges and charged particles are formed in the discharge space. Accordingly, the second discharge is generated between the C electrode lines C1 to Cm and the Q electrode lines Q1 to Qm having a relatively larger distance while a voltage caused by the wall charges and the charged particles formed by the first discharge are added to the sustaining pulses SUSPc, SUSPp and SUSPq. As a result, the first discharge between the C electrode lines C1 to Cm and the P electrode lines P1 to Pm serves as a priming discharge of the second discharge occurring between the C electrode lines C1 to Cm and the Q electrode lines Q1 to Qm. Therefore, the discharge pixel cells 51 in the prior art are discharged once for each sustaining pulse SUSPc, SUSPp and SUSPq, whereas the discharge pixel cells 51 in the present invention are discharged twice for each sustaining pulse. On the other hand, the discharge pixel cells 51 in which the address discharge is not generated, do not generate a discharge because an electric field able to cause the discharge is not applied to the corresponding discharge pixel cells 51 even when the sustaining pulses SUSPc, SUSPp and SUSPq are applied.

Figure 9:
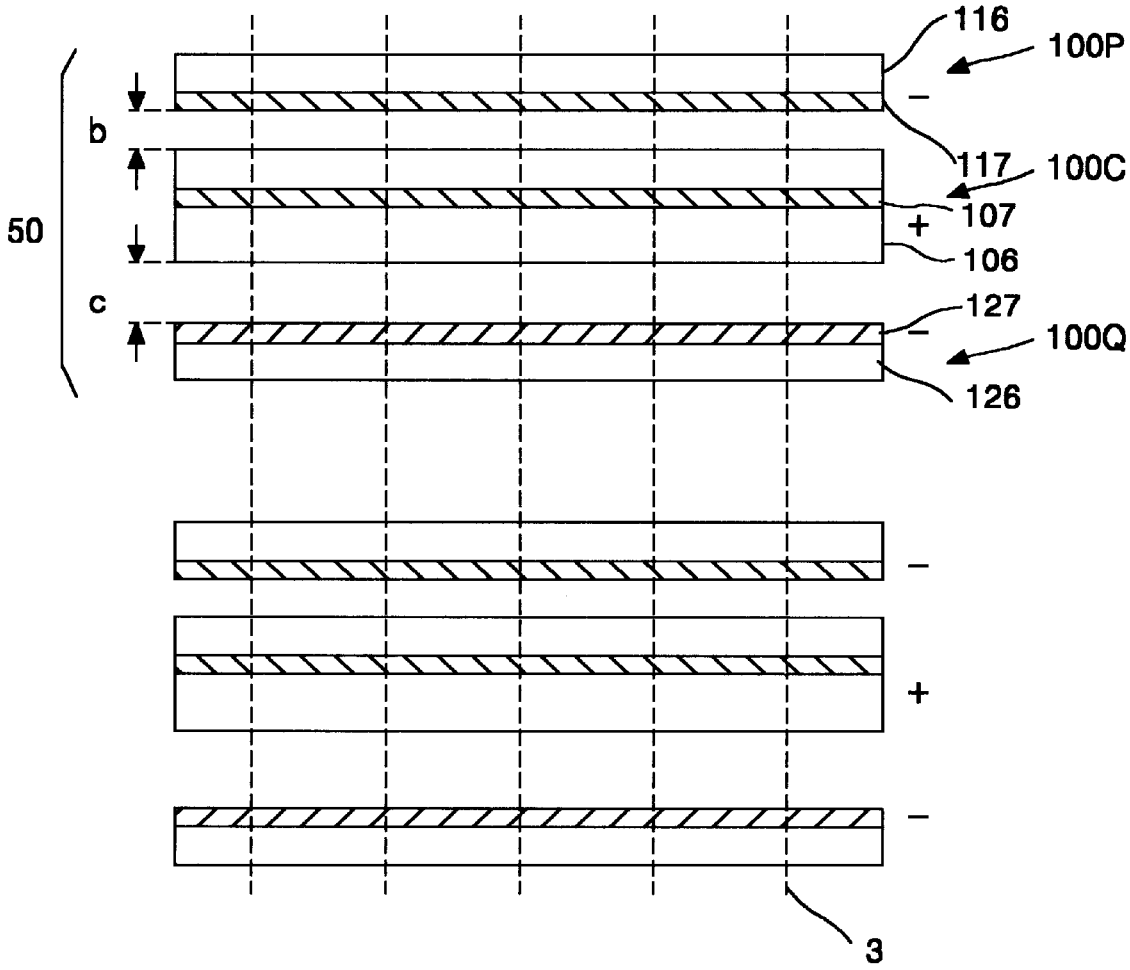
FIG. 9 is a plan view showing the polarity of sustaining electrode groups supplied with sustaining pulses in the plasma display panel of FIG. 6.

In the sustaining interval, the sustaining pulses SUSPp and SUSPq applied to the P electrode lines P1 to Pm and the Q electrode lines Q1 to Qm contiguous to the adjacent discharge spaces 50 have the same polarity as shown in FIG. 8 and FIG. 9. Accordingly, a mis-discharge is not generated between the adjacent discharge spaces 50.

As the discharge frequency for each sustaining pulse SUSPc, SUSPp and SUSPq becomes greater as mentioned above, an amount of the vacuum ultraviolet ray is increased to that extent. Also, a luminous frequency of the fluorescent layer 5 is increased and the light power is enlarged.

Figure 10:
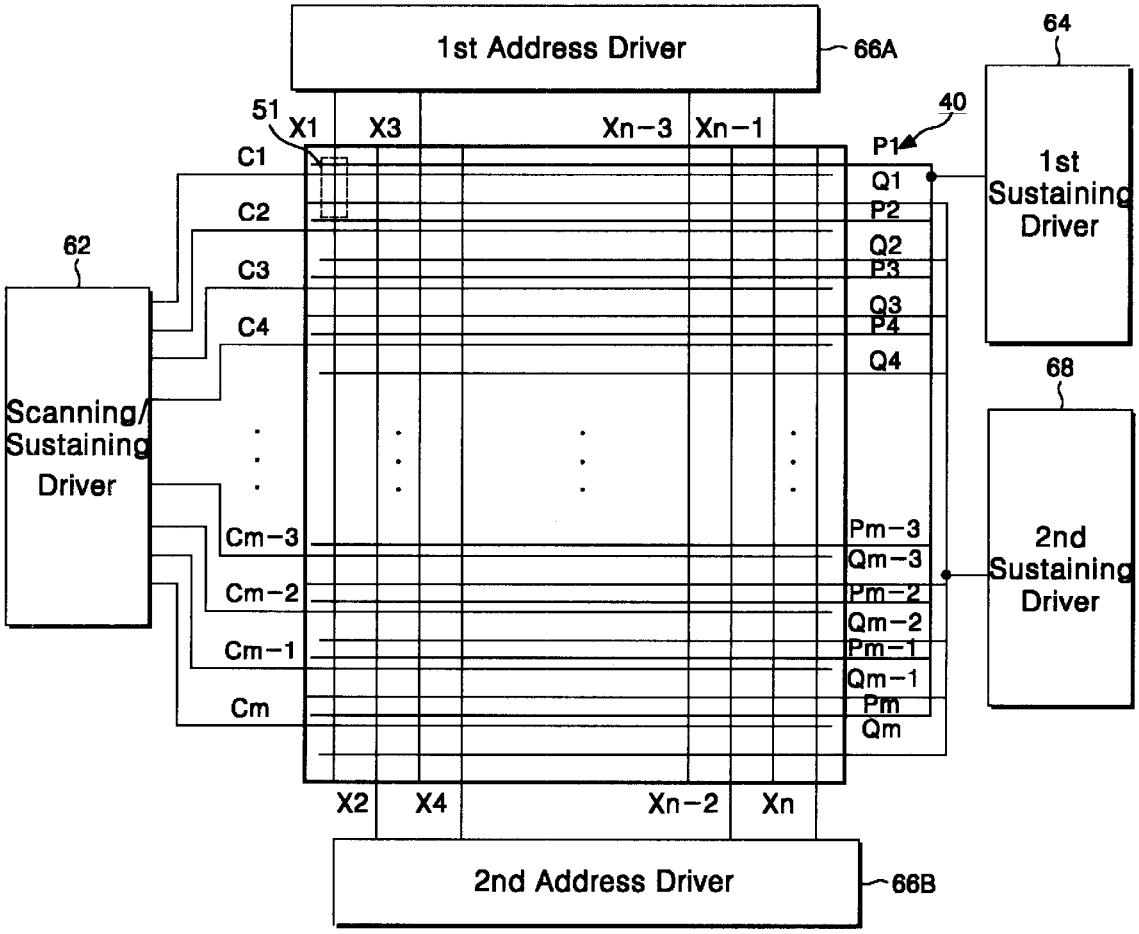
FIG. 10 is a schematic block diagram showing a plasma display panel according to a second embodiment of the present invention and a driving apparatus thereof.

Referring to FIG. 10, there is shown a PDP driving apparatus according to a second embodiment of the present invention. In FIG. 10, the PDP driving apparatus includes a scanning/sustaining driver 62 for driving C electrode lines C1 to Cm, a first common sustaining driver 64 for driving P electrode lines P1 to Pm, a second common sustaining driver 68 for driving Q electrode lines Q1 to Qm, and first and second address driver 66A and 66B for driving X electrode lines X1 to Xn. The scanning/sustaining driver 62 is connected to the C electrode lines C1 to Cm to thereby select a scanning line to be displayed and cause a sustaining discharge at the selected scanning line. The first common sustaining driver 64 is commonly connected to the P electrode lines P1 to Pm to apply sustaining pulses with same waveform to all the P electrode lines P1 to Pm, thereby causing the sustaining discharge. The second common sustaining driver 68 is commonly connected to the Q electrode lines Q1 to Qm to apply sustaining pulses with same waveform to all the Q electrode lines Q1 to Qm, thereby causing the sustaining discharge. Herein, a sustaining pulse applied to the Q electrode lines Q1 to Qm is set to have a voltage higher than a sustaining pulse applied to the P electrode lines P1 to Pm so that the second discharge can be easily generated between the C electrode lines C1 to Cm and the Q electrode lines Q1 to Qm. Also, the sustaining pulse applied to the Q electrode lines Q1 to Qm is set to have a delayed phase in comparison to the sustaining pulse applied to the P electrode lines P1 to Pm so as to utilize a priming effect caused by the first discharge. The first address driver 66A supplies odd-numbered X electrode lines X1, X3, . . . , Xn−3, Xn−1 with video data, whereas the second address driver 66B supplies even-numbered X electrode lines X2, X4, . . . , Xn−2, Xn with video data.

Figure 11:
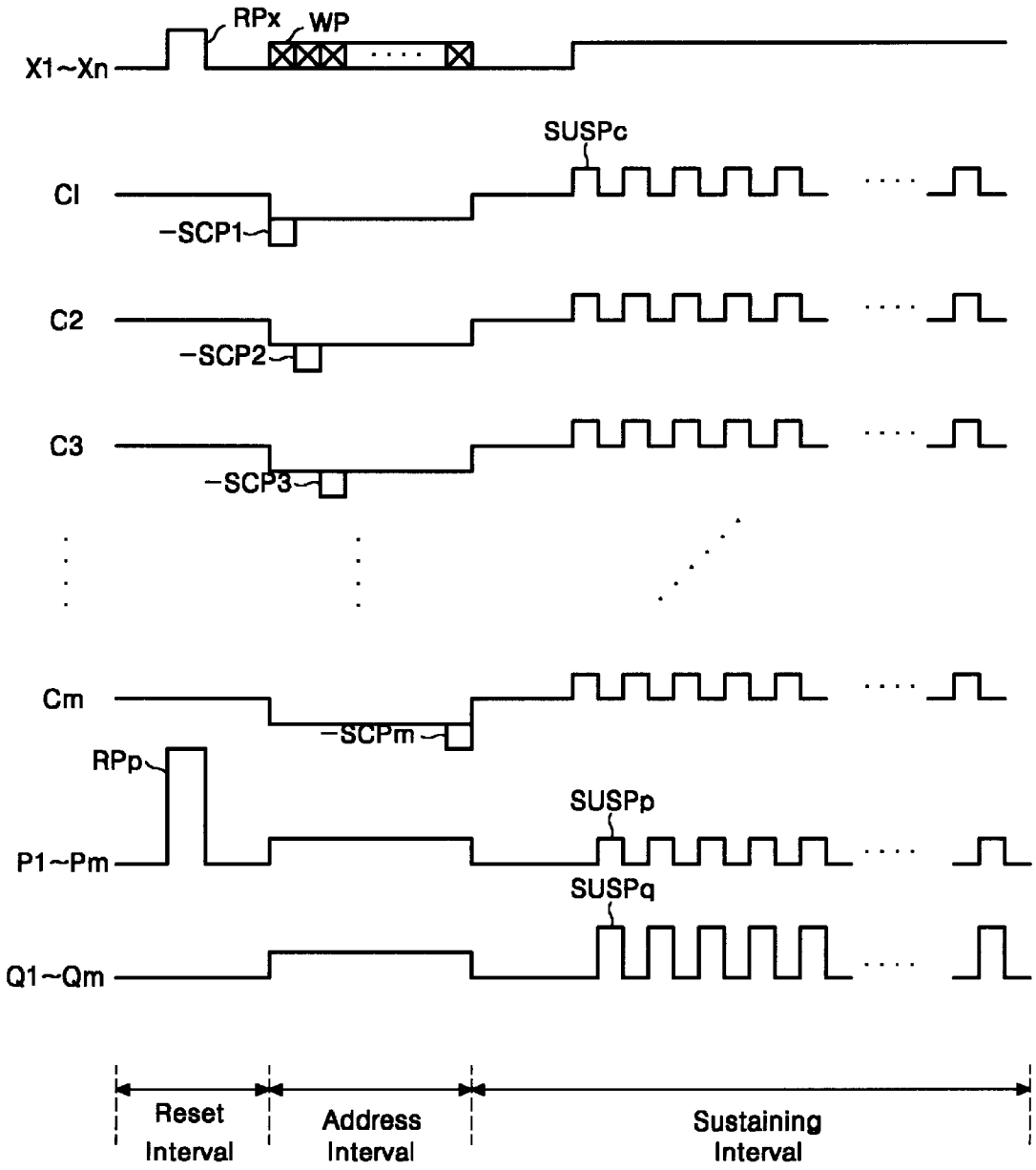
FIG. 11 shows driving waveforms for explaining a driving method of the plasma display panel according to a second embodiment of the present invention.

FIG. 11 shows drive signals applied to the PDP 40 by the driving apparatus in FIG. 10. Referring to FIG. 11, the PDP is driven with being divided into a reset interval, an address interval and a sustaining interval. Reset pulses RPx and RPp are applied to the X electrode lines X1 to Xn and the P electrode lines P1 to Pm in the reset interval. A reset discharge is generated between all the X electrode lines X1 to Xn and all the P electrode lines P1 to Pm within the PDP 40 by the reset pulses RPx and RPp to thereby initialize the entire field. In the address interval, an address discharge is generated between the X electrode lines X1 to Xn and the C electrode lines C1 to Cm by voltage differences between a writing pulse WP to the X electrode lines X1 to Xn and scanning pulses −SCP1, −SCP2, . . . , −SCPm applied to the C electrode lines C1 to Cm sequentially. By this address discharge, the discharge pixel cells 51 displaying a data are selected. In the sustaining interval, a sustaining pulse SUSPc is applied to the C electrode lines C1 to Cm. Also, a sustaining pulse SUSPp having an inverted phase with respect to the sustaining pulse SUSPc applied to the C electrode lines C1 to Cm is applied to the P electrode lines P1 to Pm. In addition, a sustaining pulse SUSPq having an inverted phase with respect to the sustaining pulse SUSPc applied to the C electrode lines C1 to Cm and a higher voltage level than the sustaining pulse SUSPp applied to the P electrode lines P1 to Pm. Then, a sustaining discharge is generated between the C electrode lines C1 to Cm and the P electrode lines P1 to Pm while sustaining pulse voltages SUSPc and SUSPp applied to the C electrode lines C1 to Cm and the p electrode lines P1 to Pm, respectively are added to wall voltages within the discharge pixel cells 51 formed in advance. As a distance between the C electrode lines C1 to Cm and the P electrode lines P1 to Pm is set narrowly, a voltage level of the sustaining pulse SUSPp applied to the P electrode lines P1 to Pm can be lowered. At the same time, a sustaining discharge is generated between the C electrode lines C1 to Cm and the Q electrode lines Q1 to Qm while the sustaining pulse voltages SUSPc and SUSPq applied to the C electrode lines C1 to Cm and the Q electrode lines Q1 to Qm, respectively are added to wall voltages within the discharge pixel cells 51 formed in advance. As a distance between the C electrode lines C1 to Cm and the Q electrode lines Q1 to Qm is set to have a relatively large value, a voltage level of the sustaining pulse SUSPp applied to the Q electrode lines Q1 to Qm is set highly so that a sustaining discharge can be stabbly generated between the C electrode lines C1 to Cm and the Q electrode lines Q1 to Qm. Accordingly, when the sustaining pulses SUSPc, SUSPp and SUSPq are applied to the P electrode lines P1 to Pm and the Q electrode lines Q1 to Qm, the discharge pixel cells 51 generate a sustaining discharge at the left and right sides around the C electrode lines C1 to Cm. On the other hand, the discharge pixel cells 51 in which the address discharge is not generated, do not generate a sustaining discharge because an electric field able to cause the discharge is not applied to the corresponding discharge pixel cells 51 even when the sustaining pulses SUSPc, SUSPp and SUSPq are applied.

In the sustaining interval, the sustaining pulses SUSPp and SUSPq applied to the P electrode lines P1 to Pm and the Q electrode lines Q1 to Qm contiguous to the adjacent discharge spaces 50 have the same polarity as shown in FIG. 10 and FIG. 11.

Figure 12:
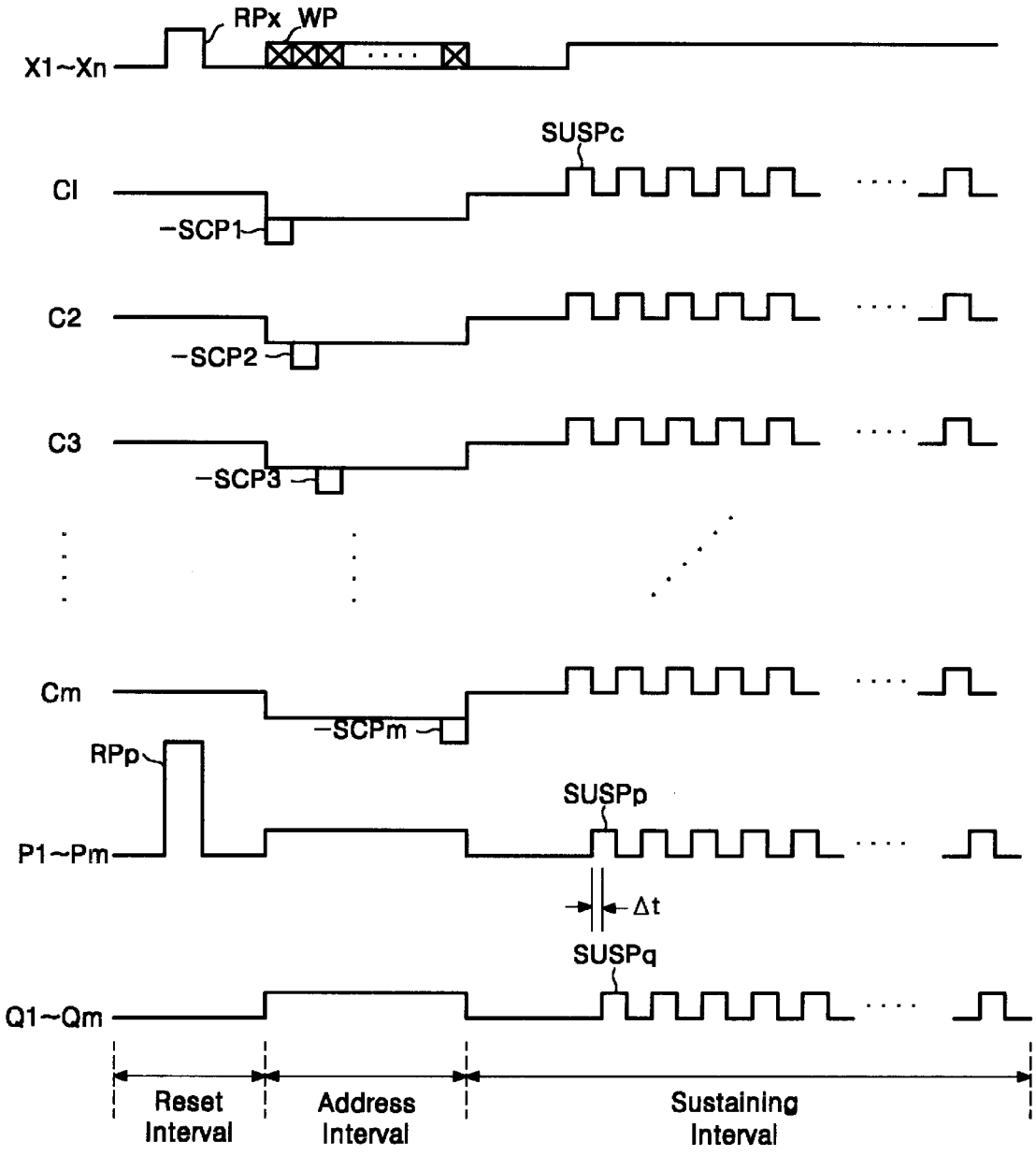
FIG. 12 shows driving waveforms for explaining a driving method of the plasma display panel according to a third embodiment of the present invention.

FIG. 12 shows another drive signal cycle applied to the PDP 40 by means of the driving apparatus in FIG. 10. Referring to FIG. 12, the PDP is driven with a drive cycle being divided into a reset interval, an address interval and a sustaining interval. Reset pulses RPx and RPp are applied to the X electrode lines X1 to Xn and the P electrode lines P1 to Pm, respectively, in the reset interval to thereby initialize the entire field. In the address interval, an address discharge is generated between the X electrode lines X1 to Xn and the C electrode lines C1 to Cm by voltage differences between a writing pulse WP to the X electrode lines X1 to Xn and scanning pulses −SCP1, −SCP2, . . . , −SCPm applied to the C electrode lines C1 to Cm sequentially. By this address discharge, the discharge pixel cells 51 displaying data are selected. In the sustaining interval, a sustaining pulse SUSPc is applied to the C electrode lines C1 to Cm. Also, a sustaining pulse SUSPp having an inverted phase with respect to the sustaining pulse SUSPc applied to the C electrode lines C1 to Cm is applied to the P electrode lines P1 to Pm. In addition, a sustaining pulse SUSPq having an inverted phase with respect to the sustaining pulse SUSPc applied to the C electrode lines C1 to Cm and delayed, by a desired delay time Δt, with respect to the sustaining pulse SUSPp applied to the P electrode lines P1 to Pm. Then, the first discharge is generated between the C electrode lines C1 to Cm and the P electrode lines P1 to Pm while sustaining pulse voltages SUSPc and SUSPp applied to the C electrode lines C1 to Cm and the p electrode lines P1 to Pm, respectively are added to wall voltages within the discharge pixel cells 51 formed in advance. By this first discharge, wall charges and charged particles are formed within the discharge pixel cells 51. Subsequently, a sustaining pulse SUSPq is applied to the Q electrode lines Q1 to Qm. Then, the discharge pixel cells 51 generate the second discharge while wall voltages within the discharge pixel cells 51 formed by the first discharge are added to the sustaining pulse SUSPq. By a priming effect caused by the first discharge occurring between the C electrode lines C1 to Cm and the P electrode lines P1 to Pm, a discharge can be generated between the C electrode lines C1 to Cm and the Q electrode lines Q1 to Qm with a low voltage caused by a relatively larger electrode distance. Accordingly, whenever the sustaining pulses SUSPc, SUSPp and SUSPq are applied to the P electrode lines P1 to Pm and the Q electrode lines Q1 to Qm, the discharge pixel cells 51 generate a sustaining discharge with a desired delay time At continuously at the left and right sides around the C electrode lines C1 to Cm. On the other hand, the discharge pixel cells 51 in which the address discharge is not generated, do not generate a sustaining discharge because an electric field able to cause the discharge is not applied to the corresponding discharge pixel cells 51 even when the sustaining pulses SUSPc, SUSPp and SUSPq are applied.

The size and the application time of the sustaining pulses SUSPp and SUSPq applied to the P electrode lines P1 to Pm and the Q electrode lines Q1 to Qm as mentioned above are controlled, so that the sustaining electrode group can be driven stably. In addition, the pulse widths of the sustaining pulses SUSPp and SUSPq applied to the P electrode lines P1 to Pm and the Q electrode lines Q1 to Qm may be set differently.

As described above, according to the present invention, each sustaining electrode group consisting of three electrodes is included and a discharge is generated continuously and simultaneously between the three electrodes with every sustaining pulse applied in the sustaining interval, so that the brightness can be improved. For instance, a time contributing to a real luminescence upon application of each sustaining pulse in the sustaining interval is only about 1 $\mu$s in the case of the prior art, whereas the sustaining electrode group is driven in two divided regions to cause the first discharge and the second discharges, thereby increasing a time contributing to the luminescence as well as improving the brightness with the same power in the present invention. In addition, the second discharge is generated by taking advantage of the priming effect caused by the first discharge in making a two-stage driving of the sustaining electrode group consisting of the three electrodes, so that the discharge efficiency can be improved. Moreover, according to the present invention, the same polarities of sustaining pulses are applied to the sustaining electrodes contiguous to the adjacent discharge spaces, so that a mis-discharge between the adjacent discharge spaces can be prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a front substrate and a rear substrate having a predetermined space from each other;

a plurality of sustaining electrode groups spaced along the surface of the front substrate opposite to the rear substrate; and an address electrode group on the surface of the rear substrate opposite to the front substrate, each sustaining electrode group having at least three electrodes including a center electrode and two side electrodes, respectively spaced at different distances from the center electrode.

2. The plasma display panel as claimed in claim 1, wherein a width of said center electrode is wider than widths of the side electrodes.

3. The plasma display panel as claimed in claim 2, wherein each of said center and side electrodes is made from an assembly of a transparent electrode and a metal electrode, and the metal electrode of the center electrode assembly is offset from any one side of the side electrodes, and the metal electrode on the center electrode assembly is offset from the center of the transparent electrode of the center electrode assembly.

4. The plasma display panel as claimed in claim 2, wherein the metal electrodes of said second and third electrode are offset toward the center electrode on the transparent electrodes thereof.

5. A driving apparatus for a plasma display panel having a plurality of electrodes formed on a rear substrate, a plurality of electrodes formed on a front substrate opposite to the rear substrate in such a manner to be perpendicular to the electrodes on the rear substrate, and a discharge cell arranged at intersections between the electrodes on the rear substrate and the electrodes on the front substrate, said apparatus comprising:

a plurality of sustaining electrode groups including at least three electrodes, each sustaining electrode group having at least three electrodes including a center electrode and two side electrodes, respectively spaced at different distances from the center electrode; and a sustaining electrode driver for applying the same polarity of voltage signals to electrodes positioned at the outermost portions of each side of said at least three electrodes.

6. The driving apparatus as claimed in claim 5, wherein said sustaining electrode driver applies a sustaining discharge voltage to each of the side electrodes of a different magnitude, respectively.

7. The driving apparatus as claimed in claim 6, wherein said sustaining electrode driver applies a smaller magnitude of sustaining discharge voltage to the one side electrode having a lesser distance from the center electrode, whereas it applies a larger magnitude of sustaining discharge voltage to the other side electrode having a larger distance from the center electrode.

8. The driving apparatus as claimed in claim 5, wherein said sustaining electrode driver sets the sustaining discharge voltage applied to each of the second and third electrodes to have a different application time.

9. The driving apparatus as claimed in claim 8, wherein said sustaining electrode driver applies the sustaining discharge voltage to one side electrode having a greater distance from the center electrode after it applies the sustaining discharge voltage to the other side electrode having a lesser distance from the center electrode.

10. The driving apparatus as claimed in claim 5, wherein said sustaining electrode driver applies a scanning signal and a sustaining discharge voltage to the center electrode.

11. The driving apparatus as claimed in claim 10, wherein said sustaining electrode driver sets a pulse width of the sustaining discharge voltage applied to each of the side electrodes to have different respective values.

12. A method of driving a plasma display panel having a plurality of electrodes formed on a rear substrate, a plurality of electrodes formed on a front substrate opposite to the rear substrate perpendicular to the electrodes on the rear substrate, and discharge cells arranged at intersections between the electrodes on the rear substrate and the electrodes on the front substrate, said method comprising the steps of:

providing a plurality of sustaining electrode groups on the front substrate from at least three electrodes, each sustaining electrode group having at least three electrodes including a center electrode and two side electrodes, respectively spaced at different distances from the center electrode; and driving said at least three electrodes with voltages to thereby generate at least two discharges continuously for each of said groups.

13. The method as claimed in claim 12, further comprising the steps of:

applying the same polarity of voltage signals to side electrodes of each of the sustaining electrode groups.

14. The method as claimed in claim 13, further comprising the step of:

setting a sustaining discharge voltage applied to each of the side electrodes to have different magnitudes.

15. The method as claimed in claim 13, further comprising the step of:

setting the sustaining discharge voltage applied to each of the side electrodes to have different application times.

16. The method as claimed in claim 13, further comprising the step of:

applying a scanning signal and a sustaining discharge voltage to the center electrode.

17. The method as claimed in claim 13, further comprising the step of:

setting a pulse width of the sustaining discharge voltage applied to each of the electrodes to have different values.

* * * * *